US008485002B2

(12) United States Patent
Quandt et al.

(10) Patent No.: US 8,485,002 B2
(45) Date of Patent: Jul. 16, 2013

(54) PLASTIC TUB FOR A WASHING MACHINE OR A WASHER DRYER

(75) Inventors: Christian Quandt, Falkensee (DE); Holger Reichner, Prenzlau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 562 days.

(21) Appl. No.: 12/677,120

(22) PCT Filed: Sep. 5, 2008

(86) PCT No.: PCT/EP2008/061730

§ 371 (c)(1), (2), (4) Date: Mar. 9, 2010

(87) PCT Pub. No.: WO2009/040231

PCT Pub. Date: Apr. 2, 2009

(65) Prior Publication Data

US 2010/0186462 A1 Jul. 29, 2010

(30) Foreign Application Priority Data

Sep. 20, 2007 (DE) ..... 10 2007 044 883

(51) Int. Cl.
*D06F 37/26* (2006.01)

(52) U.S. Cl.
USPC ..... 68/140; 68/142; 68/232

(58) Field of Classification Search
USPC ..... 68/3 R, 232, 139, 140, 142; D32/29
See application file for complete search history.

(56) References Cited

U.S. PATENT DOCUMENTS

| | | | | | |
|---|---|---|---|---|---|
| 3,599,893 | A | * | 8/1971 | Landolf et al. | 242/118.7 |
| 3,948,458 | A | * | 4/1976 | Beck et al. | 242/118.7 |
| 4,140,828 | A | * | 2/1979 | Copping | 428/167 |
| 4,762,047 | A | * | 8/1988 | Ibarra | 89/1.35 |
| 5,038,586 | A | * | 8/1991 | Nukaga et al. | 68/12.01 |
| 5,606,890 | A | * | 3/1997 | Luckas | 74/411 |
| 5,965,236 | A | * | 10/1999 | Durazzani | 428/156 |
| 7,578,151 | B2 | * | 8/2009 | Blomberg et al. | 68/142 |
| 2003/0094393 | A1 | * | 5/2003 | Sahm, III | 206/505 |
| 2005/0092034 | A1 | | 5/2005 | Hollenhorst et al. | |
| 2007/0068199 | A1 | * | 3/2007 | Dahlmann et al. | 68/30 |
| 2007/0113596 | A1 | * | 5/2007 | Kim et al. | 68/140 |

FOREIGN PATENT DOCUMENTS

| | | | | |
|---|---|---|---|---|
| DE | 43 37 631 | | * | 5/1995 |
| DE | 29821140 | U1 | | 3/1999 |
| DE | 202004012221 | U1 | | 11/2004 |
| DE | 102005018190 | B3 | | 8/2006 |
| GB | 2157326 | A | | 10/1985 |
| SU | 1440928 | A | * | 11/1988 |

* cited by examiner

*Primary Examiner* — Joseph L Perrin
(74) *Attorney, Agent, or Firm* — James E. Howard; Andre Pallapies

(57) ABSTRACT

A plastic tub for a washing machine includes a cylindrical casing; and an end face wall sealing the cylindrical casing. The end face including a bearing mount for a shaft of a laundry drum and radially-aligned reinforcing ribs molded into the end face wall. The reinforcing ribs begin at the bearing mount and branch in a Y-shape along their radial extent.

12 Claims, 3 Drawing Sheets

PLASTIC TUB FOR A WASHING MACHINE OR A WASHER DRYER

BACKGROUND OF THE INVENTION

The invention is based on a washing machine with a housing and a washing assembly suspended elastically therein, with the washing assembly containing a cylindrical plastic tub, a laundry drum mounted rotatably therein, the axis of which has an essentially horizontal alignment and a drive motor, which drives the laundry drum directly or transmits the drive from the outside via a pulley. To support the drum shaft, the end face wall of the tub has a bearing mount.

During operation of the washing machine, in particular when spinning, enormous rotational and bending forces arise, which are generated by the rotational movement of the laundry drum and transmitted onto the tub. The load of the tub increases with the size of the drum and the load quantity. The dynamics of the forces acting on the tub are dependent on the speed of the laundry drum, the force effect on the tub intensifies particularly when the drum is starting up.

In the case of the front-loadable washing machine, the drum is mounted on one side. With these washing machines known as front loaders, the bending and rotatary forces transmitted by the laundry drum have to be taken up by the bearing mount in the end face wall of the tub and transmitted and/or distributed across the whole surface thereof. The requirements and/or mechanical rigidity are particularly high with this type of washing machine. The construction of such a tub must exhibit an adequate rigidity in order to be able to withstand all loads with, for the construction of the tub, account being taken of the fact that the mechanical stress in the region of the bearing mount is at its greatest and reduces from the bearing mount across the end face wall to the tub casing.

It one assumes that the service life of a washing machine amounts to more than 10 years, a tub has to be designed such that it can fulfill all functional requirements over such a long period of time, particularly in respect of its ability to withstand the mechanical stresses transmitted by the drum and in respect of its water tightness and the corrosion resistance.

Another demand made on mass products such as washing machines is that their individual modules, such as the tub in the present instance, not only have to satisfy the functional requirements but must also be economical in terms of manufacture and problem-free in terms of recycling when the washing machine has reach the end of its service life.

To ensure that the tub is made suitably stable, plastic tubs have been developed for washing machines, in which additional stabilizing means are used in particular for the end face wall and the bearing mount. Webs and/or ribs or a metal bearing cross integrated in the plastic of the end face wall are known from the prior art as stabilizing means.

Plastic tubs with a metallic bearing cross integrated in the plastic of the end face wall are described in literature in various forms. A known method of manufacturing such plastic tubs is injection molding such that the bearing cross is firstly arranged in the mold of the injection machine and the injection itself then takes place. Insert-molding the bearing cross enables it be fitted tightly in the end face wall.

The plastic tub with a specially configured bearing cross is described in the patent specification DE 10 2005 018 190 B3. The metallic bearing cross with the sleeve-like collar for receiving the drum shaft is characterized by specially formed recesses and/or profiling, which guide the melt flow of the plastic mass during injection molding into predetermined directions so that joint lines form, which lend additional stability to the tub in a similar fashion to the ribs.

The methods for manufacturing tubs with an injection-molded bearing cross are technologically difficult and expensive. Furthermore, the injection molding method also has a series of technical problems and disadvantages, which derive from materials being used which have very different properties:

Since the said tubs are on the one hand a container made of plastic and on the other hand a bearing cross made of metal, their different material properties have a disadvantageous effect on the cooling process following injection molding such that as a result of the different expansion coefficients and the different thermal conductivity, significant stresses arise following the injection molding of the metallic bearing cross in the tub which cause the plastic to shrink when cooled to room temperature.

The forces, which act here on the bearing cross are so large that the bearing cross can deform. Furthermore, cracks can form in the plastic and result in deposits on the boundary surfaces of the two different materials. After a longer operating time, this can result in a loss of seal of the tub and loosening of the bearing cross in the end face wall.

A further problem consists in the plastic inside the material being cooled differently to the boundary surface of the bearing cross. As a result, micro holes develop between the plastic and the bearing cross, thereby impairing the connection between the materials and possibly resulting in cracks.

As an alternative to the described plastic tubs with the bearing cross integrated in the end face wall, tubs have been developed, the stabilization means of which consist of plastic. DE 20 2004 012 221 U1 describes such a tub for instance. The rear end face wall of the tub is provided with a plurality of straight, rigid ribs, which are arranged at an equal angular distance from one another and starting from the through bearing mount, which is arranged in the middle of the rear end face wall, run radially toward the outer edge of the end face wall.

The ribs are a component of the end face wall, they are formed using injection molding during their manufacture. The metallic bearing cross as an additional component is omitted. The unification of technology made possible by this method brings with it not inconsiderable potential for rationalization, it is possible to manufacture the tub with a significantly reduced technical and financial outlay.

Tubs are also known, which, in the region of the end face wall and in addition to the radial reinforcement ribs, also comprise meander, star, oval, circular or conical stress-relief profiles. The profiles are embodied such that they are well suited to forces running in a number of directions.

Tubs of this type have greater rigidity compared with the previously mentioned example. This is disadvantageous for tubs in that it results in material accumulations in the cross regions of the different stress relief profiles, which, on account of the different temperature gradients cause the material to shrink differently after injection molding. The results are material stresses within the end face wall with the resulting risk of cracks forming in the material and after longer operating time, the tub becoming untight.

Practice has now shown that the described known constructions of tubs with stabilization means made of plastic cannot be used or only used to a limited degree for larger load quantities and very high spin speeds.

Adjusting the rigidity of a tub constructed in this manner to increased requirements is restricted. The rigidity of the tub can be increased up to a certain degree, by the material intensity of the end face wall and/or the stabilization means molded therein being designed higher and stronger. This possibility of the extensive amplification of the end face wall of the tub are subject to relatively limited limits, since material bursts occur with an amplification of the end face wall and the stress relief profile, said material accumulations, as described, possibly resulting in stresses and crack formations and are thus to be prevented.

Lending the tub increased rigidity by using strong plastics is not offered for economical reasons since plastics render the tub considerably more expensive.

With modern machines with spin speeds in the drum of above 1500 revolutions and a load of more than 8 kg, with the known constructions of tubs, which are exclusively manufactured from plastic, an adequate rigidity for the strong and complicated bending and rotary loads is not achievable.

Following the trend for even higher spin speeds and higher drum capacities, the requirements in terms of stability of the tub increase, thereby further reducing the possible application for the known tub.

BRIEF SUMMARY OF THE INVENTION

Based on the said prior art, the object underlying the invention is to propose a constructively improved tub for washing machines or dryers, which ensures the said high level of functional performance, can be produced more economically and is suitable for all washing machine types, in particular front loaders.

The tub configured in accordance with the present invention is characterized in that radially aligned ribs are molded in the end face wall as means for reinforcing the tub, said ribs, beginning at the bearing mount for the laundry drum shaft, branching in a Y-shaped manner along their radial extent. The stabilizing effect of the branching radial ribs can be increased by the branching points being arranged differently in respect of their radial spacing from the bearing mount and by the ribs being branched a number of times along their radial extent. The reinforcing ribs are arranged at equal distances and the branchings of the reinforcing ribs are aligned symmetrically.

With the proposed construction, it is possible to mold a large number of radially aligned ribs into the end face wall without material accumulations occurring. The branched radial ribs effect a direct force introduction which is equally distributed across the surface of the end face wall from the bearing mount to the edge of the end face wall.

In a long-term test under practical conditions the inventive tub was superior to previously known constructions. The tub is robust enough to withstand the mechanical stresses which are transmitted in the case of modern washing machines from the laundry drum to the tub during operation.

In a further embodiment of the invention, provision is made, as a function of the number of radial ribs and the distance between them, to configure the width and/or the wall intensity of the reinforcing ribs and the wall intensity of the end face wall to one another such that the rigidity of the end face wall reduces evenly from the edge to the bearing housing.

This produces the essential advantage of being able to manufacture a tub with the mechanical rigidity required for each application by taking the effective material usage for each drum size into account.

In a further embodiment of the invention, transverse ribs are molded in the end face wall in addition to the radial reinforcing ribs, with the node points of the radial reinforcing ribs and the transverse ribs being arranged concentrically relative to the bearing housing, i.e. at an equal distance from the bearing housing. Transverse ribs are embodied in a straight line between the individual node points. With the additional transverse ribs, the bending stresses can be better accommodated.

No problems result during the implementation of the invention during manufacture. The changed construction prevents the procedure from having to be changed during the manufacture of the tub. The additional outlay associated with the invention is restricted to the changed shape of the injection mold. Special adjustments or tools are not needed.

BRIEF DESCRIPTION OF THE DRAWINGS

Exemplary embodiments of the invention are described in more detail below with reference to the drawings cited below, in which.

DETAILED DESCRIPTION OF EXEMPLARY EMBODIMENTS OF THE PRESENT INVENTION

Figure 1:
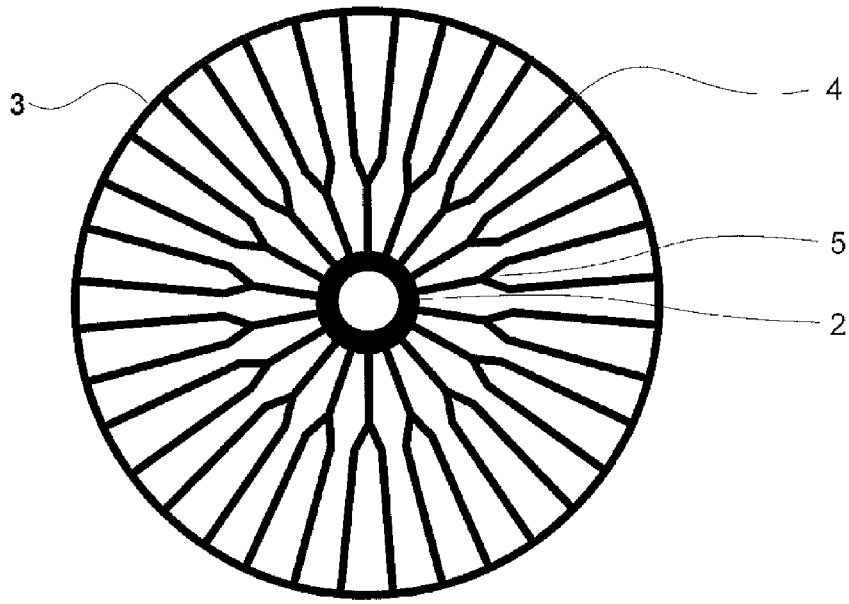
FIGS. 1 to 3 show overhead views of three embodiments of the end face wall from the rear.

FIG. 1 shows an end face wall 3 of the tub 1 in the simplest form. The radial ribs 4 are simply branched along their radial extent, are symmetrically embodied and have a Y-shape. All branching points 5 are equally distanced from the bearing mount 2. The Y-shaped transition connects all radial ribs 4 directly to the bearing mount 2, i.e. the load introduction point. The direct connection with the bearing mount 2 provides an effective force introduction, sudden changes in stress and rigidity are avoided.

Figure 2:
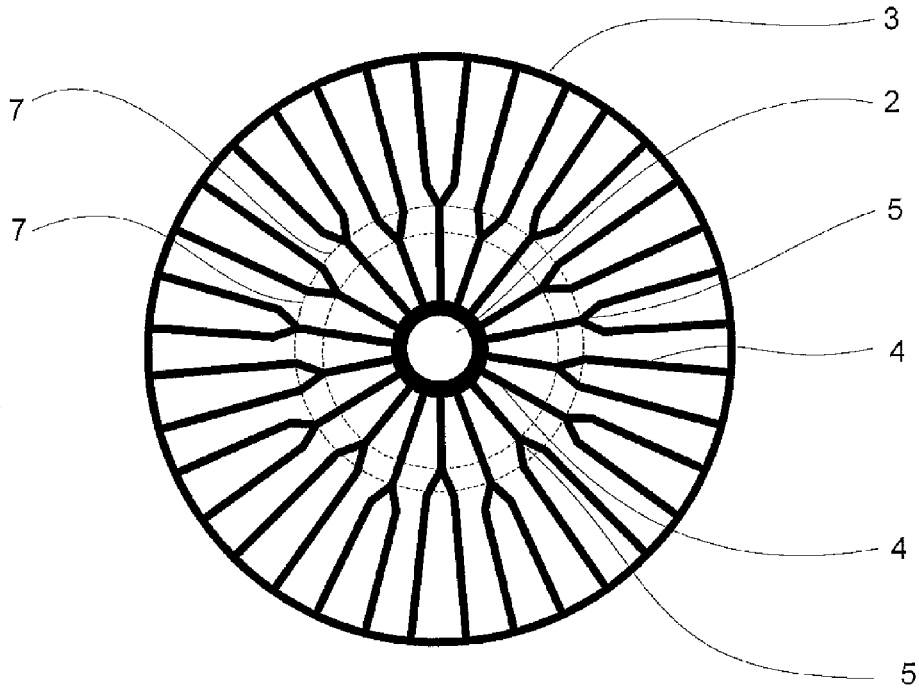

An alternative form of the end face wall 3 is shown in FIG. 2, in which the branching points 5 of adjacent ribs 4 are arranged at different distances to the bearing mount 2, and embodied such that the branching points 5 are arranged on two concentric circular lines 7.

Figure 3:
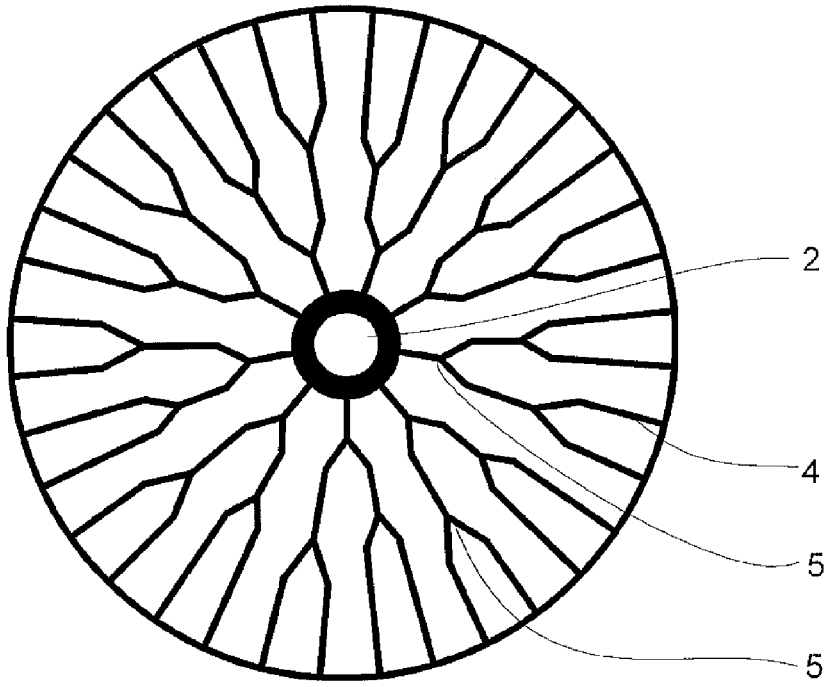

FIG. 3 shows an embodiment of the front side wall 3 with radial ribs 4, which are branched twice along their radial extent. The branching points 5 closer to the edge of the end face wall 3 are arranged radially offset in the second example. It is possible with this embodiment variant to arrange marginally distanced radial ribs 4 in the edge region of the end face wall 3. End face walls 3 with multiply branched radial ribs 4 are particularly suited to tubs 1 with a large diameter.

The two embodiments shown in FIGS. 2 and 3 are advantageous in that the differences in the distances of adjacent radial ribs 4 can be minimized, thereby achieving an equal force distribution on the surface of the end face wall 3.

Figure 4:
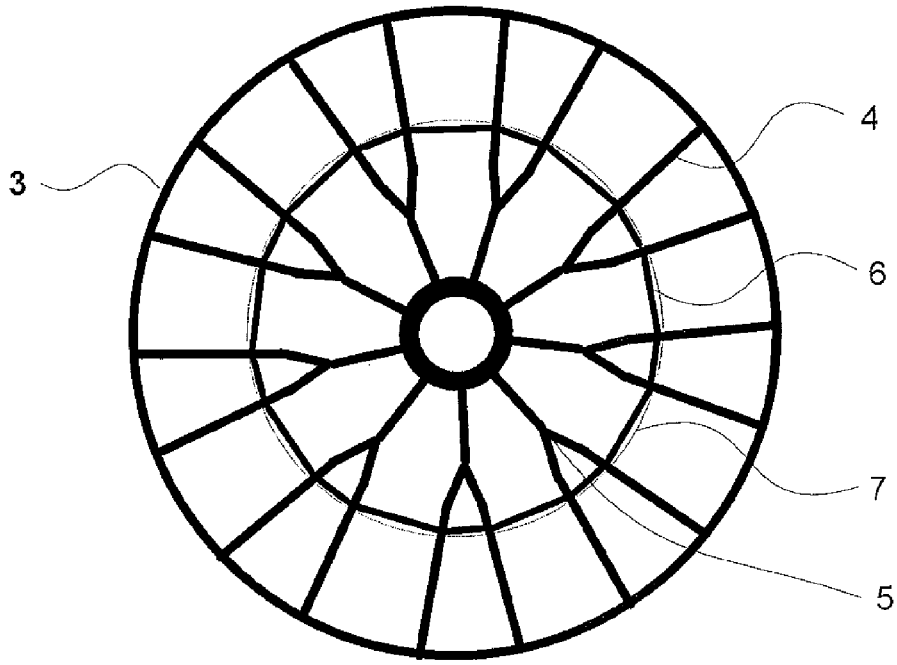
FIG. 4 shows an end face wall with transverse ribs

FIG. 4 shows an end face wall 3 with additionally molded transverse ribs 6, the node points of which are arranged concentrically with the bearing mount 2 with the radial ribs 4 on a circular line 7 and form a closed ring. The arrangement of the transverse ribs 6 takes place so that this experiences as high a bend as possible under load. The bending of the end face wall 3 under load is determined for each tub type as a function of the different structure of the radial ribs 4. In the exemplary embodiment, transverse ribs 6 are molded in a ring. A number of rings of transverse ribs can be arranged, depending on the size of the laundry drum and the bend under load.

Figure 5:
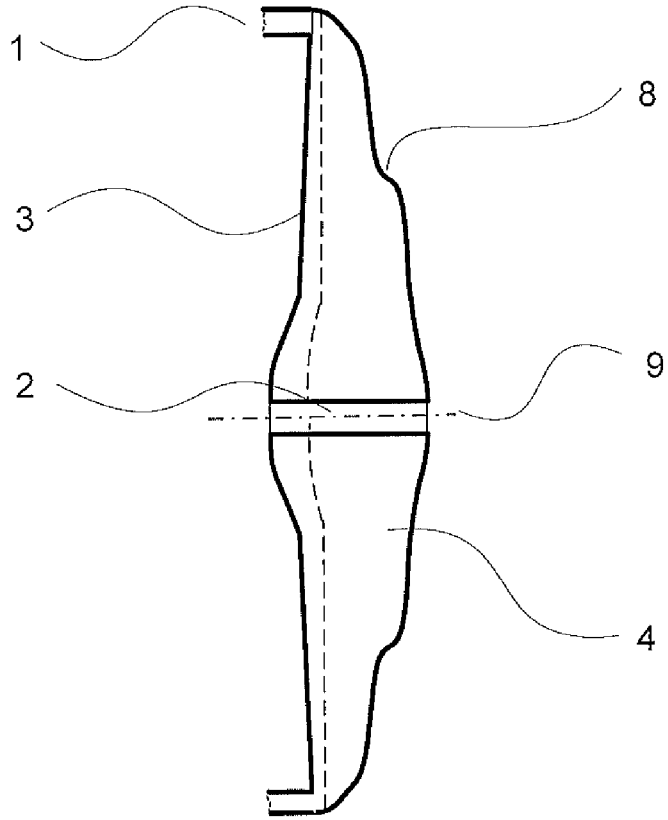
FIG. 5 shows an end face wall in a sectional representation along the drum axis.

FIG. 5 shows a preferred embodiment of the inventive tub 1. The rib height increases from the bearing mount 2 to the edge. The form of the radial ribs 4 is configured in an installation-space dependent fashion in accordance with the overall construction of the washing machine. The shoulder 8 in the exemplary embodiment is used to accommodate a pulley (not shown) in a space-saving fashion.

In this expedient embodiment the width of the end face wall 3, indicated by the dashed line, is embodied to be narrower at the edge than in the region of the bearing mount 2. Varying the width of the end face wall 3 is a further means of adjusting the rigidity of areas of the tub in the desired manner.

REFERENCE CHARACTERS

1. Tub/housing surface
2. Bearing mount
3. End face wall
4. Reinforcing ribs
5. Branching/branching points
6. Transverse ribs
7. Circular line
8. Molding/shoulder
9. Axis of the laundry drum

The invention claimed is:

1. A plastic tub for a washing machine comprising:
a cylindrical casing; and
an end face wall sealing the cylindrical casing, the end face wall including a bearing mount for a shaft of a laundry drum and an annular array of radially-aligned, plastic reinforcing ribs molded into the end face wall, the reinforcing ribs extending in a radial direction from the bearing mount, each reinforcing rib branching into a first Y-shape having two branches, each of said two branches expanding into second and third Y-shapes, respectively, from node points alternately arranged on two circular lines arranged concentrically to the bearing mount.

2. The plastic tub of claim 1, wherein the branching of the Y-shaped reinforcing ribs is symmetrical.

3. The plastic tub of claim 1, wherein the reinforcing ribs are aligned symmetrically to one another and at an equal distance about said bearing mount.

4. The plastic tub of claim 1, wherein a height, width and/or wall strength of the reinforcing ribs and a wall strength of the end face wall are attuned to one another such that a rigidity of the end face wall increases evenly from an outer edge to the bearing mount.

5. The plastic tub of claim 1, further comprising transverse ribs connecting the reinforcing ribs molded in the end face wall, with individual transverse ribs forming a closed ring.

6. The plastic tub of claim 5, wherein node points of the transverse ribs are arranged on a third circular line arranged concentrically to the bearing mount.

7. The plastic tub of claim 5, wherein individual sections of the transverse ribs are in a straight line between the reinforcing ribs.

8. A plastic tub for a washing machine comprising:
a cylindrical casing; and
an end face wall sealing the cylindrical casing, the end face wall including a bearing mount for a shaft of a drum located within said cylindrical casing, and an annular array of radially-aligned, plastic reinforcing ribs molded into the end face wall, the reinforcing ribs extending in a radial direction from the bearing mount, each reinforcing rib branching into a first Y-shape having two branches, each of said two branches expanding into second and third Y-shapes, respectively, from node points alternately arranged on two circular lines concentrically arranged relative to the bearing mount; wherein a height, width and wall strength of the reinforcing ribs and a wall strength of the end face wall are attuned to one another such that a rigidity of the end face wall increases evenly from an outer edge to the bearing mount; and further wherein
transverse ribs connecting the reinforcing ribs are molded in the end face wall and form a closed ring.

9. The plastic tub of claim 8, wherein the branching of the Y-shaped reinforcing ribs is symmetrical.

10. The plastic tub of claim 8, wherein the reinforcing ribs are aligned symmetrically to one another and at an equal distance about said bearing mount.

11. The plastic tub of claim 8, wherein individual sections of the transverse ribs are in a straight line between the reinforcing ribs.

12. The plastic tub of claim 11, wherein node points of the transverse ribs are arranged on a third circular line arranged concentrically to the bearing mount.

* * * * *